US005975949A

United States Patent [19]

Holliday et al.

[11] Patent Number: 5,975,949

[45] Date of Patent: Nov. 2, 1999

[54] CRIMPABLE CONNECTOR FOR COAXIAL CABLE

[75] Inventors: Randall A. Holliday, 1005 Mead Ct., Westminster, Colo. 80030; Shen-Chia Wong, Taipei, Taiwan

[73] Assignee: Randall A. Holliday, Westiminster, Colo.

[21] Appl. No.: 08/992,996

[22] Filed: Dec. 18, 1997

[51] Int. Cl.[6] ..... H01R 9/05

[52] U.S. Cl. ..... 439/585

[58] Field of Search ..... 439/578–585, 439/271–283, 877

[56] References Cited

U.S. PATENT DOCUMENTS

| | | | |
|---|---|---|---|
| 3,501,616 | 3/1996 | Holliday | 439/585 |
| 4,990,106 | 2/1991 | Szegda | 439/585 |
| 5,525,076 | 6/1996 | Down | 439/585 |
| 5,651,699 | 7/1997 | Holliday | 439/585 |
| 5,667,405 | 9/1997 | Holliday | 439/585 |

*Primary Examiner*—Khiem Nguyen
*Attorney, Agent, or Firm*—John E. Reilly

[57] ABSTRACT

A coaxial cable end connector for connecting a cable to a terminal has inner and outer spaced concentric sleeves, the outer sleeve provided with sealing rings which are formed out of the thickness of the outer sleeve along a crimping zone of the sleeve to minimize the crimping force required to crimp the outer sleeve by inward radial deformation into sealing engagement with the cable. Preferably, the wall thickness of at least a portion of the outer sleeve is reduced in order to further reduce the crimping force required to deform the sleeve into sealing engagement with the cable. In certain applications, an external annular seal is interposed between confronting surface portions of one of the inner and outer sleeves and a coupling member which makes up onto the terminal in sealing against moisture infiltration.

17 Claims, 1 Drawing Sheet

CRIMPABLE CONNECTOR FOR COAXIAL CABLE

SPECIFICATION

Background and Field of Invention

This invention relates to end connectors; and more particularly relates to a novel and improved end connector adaptable for electrically and mechanically connecting a coaxial cable to a selected device, such as, a post or terminal on a cable television set.

This invention is an improvement to end connectors of the type set forth and described in my U.S. Pat. Nos. 5,501,616 for END CONNECTOR FOR COAXIAL CABLE and 5,651,699 for MODULAR CONNECTOR ASSEMBLY FOR COAXIAL CABLES. The standard coaxial cable is made up of inner and out concentric conductors separated by a dielectric insulator and encased in an outer rubber jacket. Typically, an end connector is formed with radially inner and outer spaced coaxial sleeves, the inner sleeve sized for insertion of the inner conductor and annular dielectric therein, and the outer sleeve is sized for insertion of the outer conductor and the jacket to one end of the connector between the inner and outer sleeves. As disclosed in my hereinbefore referred to U.S. Pat. No. 5,501,616, uniform sealed engagement between the end connector and coaxial cable can be achieved through the utilization of endless circular ribs extending circumferentially around an inner wall surface portion of the outer sleeve, the ribs engaging an external surface of the rubber jacket only when the cable is fully inserted into the end connector and the outer sleeve is deformed radially inwardly, such as, by crimping until the ribs effect uniform sealed engagement with the rubber jacket. To this end, I have also devised crimping tools as disclosed in U.S. Pat. No. 5,392,508 to facilitate crimping or radial deformation of the outer sleeve of the connector inwardly into uniform sealed engagement with the jacket. However, it is highly desirable to reduce the compressive force necessary for the crimping tool to deform or radially contract the outer sleeve into sealed engagement with the jacket and relieve stress without unduly weakening the outer sleeve.

In addition to effecting uniform sealed engagement between the outer sleeve and rubber jacket, there are certain applications in which the end connector is exposed to moisture between the connector body and the interface into the television set. Accordingly, a separate sealing element is required to ensure the broadest possible surface area of engagement between the connector body and terminal inwardly of the seal and maintain the most efficient electrical signal transmission into the television terminal from the cable as disclosed in my U.S. application for patent Ser. No. 593,736 filed Jan. 29, 1996 for COAXIAL CABLE CONNECTOR FOR CATV SYSTEMS and incorporated by reference herein together with the disclosure of my U.S. Pat. No. 5,501,616.

SUMMARY OF THE INVENTION

It is therefore an object of the present invention to provide for a novel and improved fitting which is specifically adaptable for use with coaxial cables.

Another object of the present invention is to provide for a fitting which is capable of effecting sealed engagement with one end of a coaxial cable by crimping a sleeve portion of the fitting onto the cable and in such a way as to relieve stress and minimize the compressive force required to effect sealed engagement therebetween.

It is a further object of the present invention to provide for a novel and improved coaxial cable end connector which is conformable for use with different cable diameters and specifically wherein it is possible to use different sized inserts for different sized cables in order to standardize the size or dimension of the basic end connector.

It is a still further object of the present invention to provide in a coaxial cable end connector for a novel and improved seal assembly which is self-centering and seals against moisture infiltration as well as radiation leakage between the connector body and television terminal or other member to which it is to be connected in establishing both a mechanical and electrical connection therebetween.

It is an additional object to provide for a novel and improved external seal assembly in an end connector body which is interchangeable for use with different cable diameters in a novel and improved manner.

In accordance with the present invention, a novel and improved form of coaxial cable connector is provided for connection to a terminal, the cable being of the type having radially inner and outer generally cylindrical conductors separated by an annular dielectric and an outer tubular jacket of a sealable material, the improved connector having radially inner and outer spaced coaxial sleeves, the inner sleeve being sized for insertion of the inner conductor and annular dielectric therein, the outer sleeve being sized for insertion of the outer conductor and jacket between the inner and outer sleeves, and a plurality of alternating inner and outer endless rings extending circumferentially of the outer sleeve adjacent to one end, the rings defining alternating ribs and grooves along an inner surface portion of the outer sleeve and being compressible into direct engagement with the jacket when the jacket is inserted into the annular space between the inner and outer sleeves whereupon inward radial compression of the other sleeve is operative to force external surface portions of the jacket into the grooves between the ribs and effect sealed engagement therewith. Preferably, the alternating ribs and grooves are so formed out of the outer sleeve as to establish a uniform wall thickness so as to relieve stress and minimize the compressive force necessary to effect sealed engagement with a coaxial cable when the outer sleeve is crimped onto the end of the cable. The alternating ribs and grooves may be of generally circular cross section or truncated V-shaped configuration; and at least a portion of the outer sleeve is reduced in wall thickness preferably by reducing the outer diameter along a portion of the outer sleeve between the endless sealing rings and the coupling portion to the terminal to further reduce the compressive force required to crimp the outer sleeve into sealed engagement with the jacket.

In those forms of connector where it is desirable to provide an external seal between the sleeves and coupling member to the terminal, an annular seal is positioned in a recessed portion formed between confronting surfaces of one of the sleeves and the coupling member in such a way as to prevent moisture infiltration through the connecting interfaces between the coupling and sleeves as well as to center the cable with respect to the terminal.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
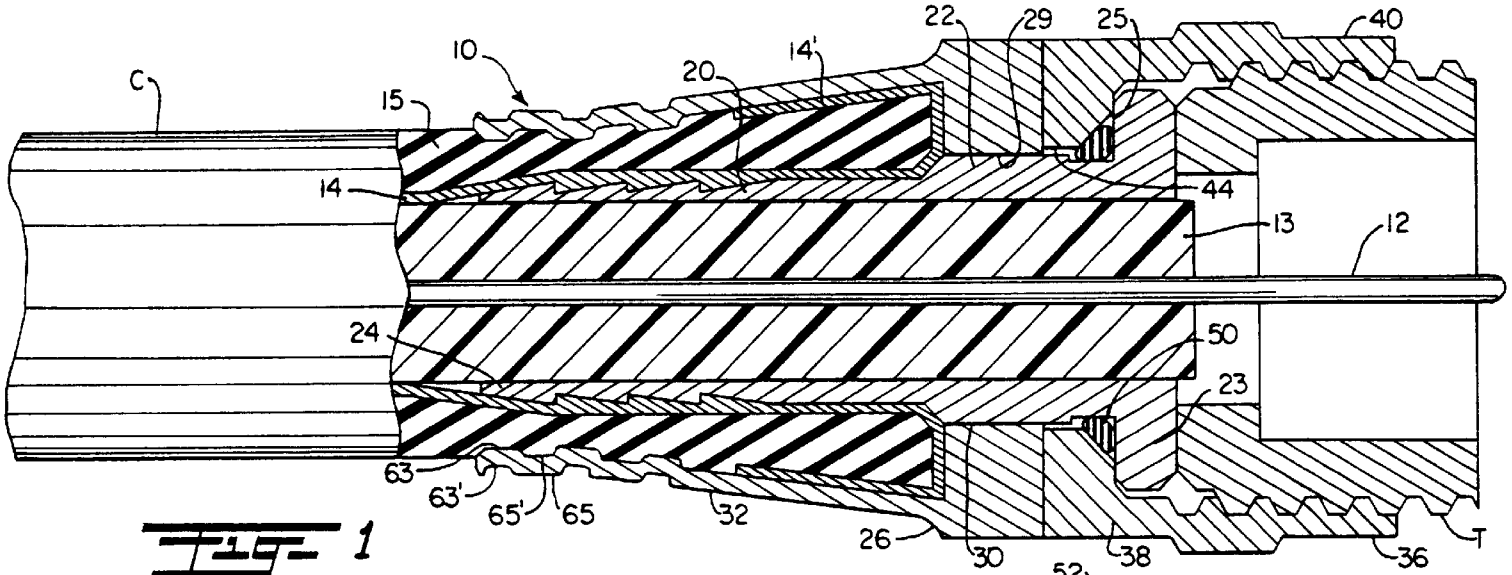
FIG. 1 is a sectional view illustrating a preferred form of end connector assembled onto the end of a coaxial cable.
Figure 2:
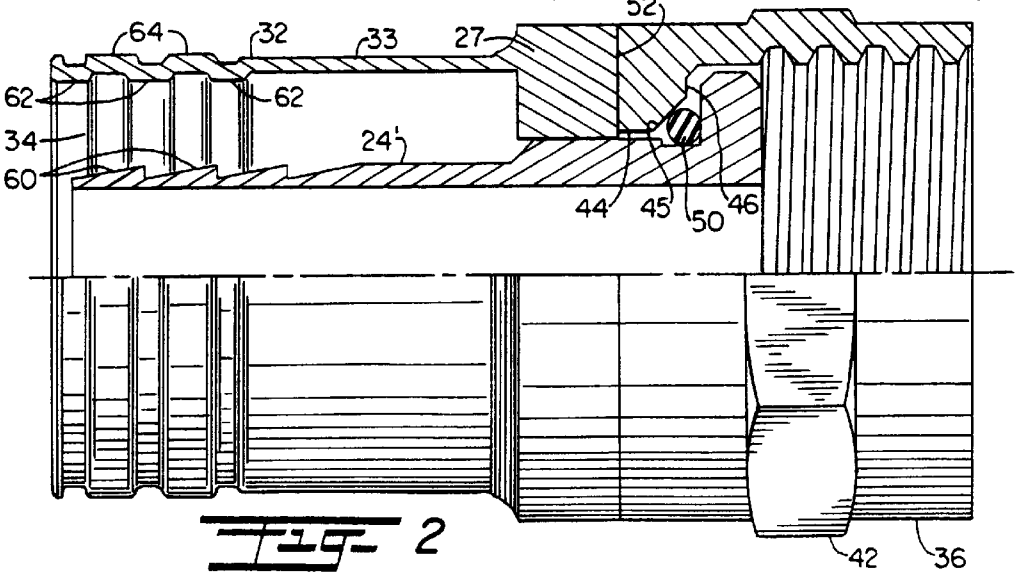
FIG. 2 is a sectional view of the preferred form of end connector shown in FIG. 1 prior to assembly onto the end of a cable.

Referring in more detail to the drawings, a preferred form of end connector 10 is illustrated in FIG. 2 which is adaptable for use in electrically and mechanically coupling a coaxial cable C, illustrated in FIG. 1, to a television terminal or post T. In accordance with conventional practice, the coaxial cable C is comprised of an inner conductor or pin 12, a dielectric insulator 13 in surrounding relation to the pin 12 and which in turn is surrounded by a braided conductor 14 and dielectric jacket 15. Further, as is standard practice in effecting connection of the cable to a television terminal, an end of the conductor pin 12 is exposed by cutting off a limited length of the insulator 13, and a portion 14' of the conductor 14 is doubled over the jacket 15 as illustrated in FIG. 1. Conventional cables C of the type used in the cable television industry have different outer diameters, owing primarily to different thicknesses of the outer conductors 14 and it is therefore important that the end connector 10 be capable of accommodating different diameters within reasonable limits.

The preferred form of end connector 10 comprises an inner sleeve 20 having a sleeve body 22, an external shoulder or flange 23 at its forward or leading end and rearward extension 24 of reduced diameter and wall thickness relative to the sleeve body 22. An outer sleeve 26 has a body 27 which defines an internal flange or shoulder provided with an inner surface 29 in press-fit relation to external surface 30 of the inner sleeve body 22; and a rearward extension wall 32 is of reduced diameter and thickness relative to the body 27 and in outer spaced concentric relation to the inner sleeve 24 so as to form an annular space 34 therebetween.

A separate fastener 36 is mounted on the forward end of the inner sleeve 20 having a radially inwardly directed flange 38 which is interposed between the outer sleeve body 27 and the flange 23 on the inner sleeve body 22. A thin-walled leading end 40 of the fastener 36 extends forwardly beyond the flange 23 for threaded engagement with the terminal or post T in a conventional manner, and flats 42 on the external surface of the fastener 36 facilitate engagement and turning by a hand wrench for the purpose of threading onto the terminal or post T. The flange 38 has an inner surface 44 in closely spaced relation to the external surface 30 of the inner sleeve body, and beveled surface portion 45 is formed between the inner surface portion 44 and radial surface 46 of the flange 38. Referring to FIG. 2, the surface 46 is normally disposed in spaced parallel relation to a radial wall surface 25 on the flange 23 of the inner sleeve body 22 prior to threading the fastener 36 onto the post T, and an O-ring seal member 50 of generally circular cross-section is interposed between the beveled surface 45 and the corner or intersection of the radial wall surface 25 and external wall surface 30 of the sleeve body 22.

When the fastener 36 is made up onto the complementary external threads of the post T and tightened until the flange 23 bears against the end of the terminal or post, the flange 38 will squeeze the O-ring seal 50 causing it to flatten so as to completely fill the space between the beveled end surface 45 and the corner formed between the flange 23 and sleeve body 22 as hereinbefore described and as illustrated in FIG. 1. In turn, the enlarged flange or shoulder 23 is provided with a flat radial wall surface 52 which establishes a broad surface of engagement with the end of the terminal T for optimal electrical signal transmission from the cable C via the inner sleeve connector body 22 and flange 23 into the terminal T. As a result the seal member 50 effectively prevents moisture infiltration through the space between the flange 23 and body 22.

In order to assist in effecting sealed engagement between the inner and outer sleeves 20 and 26 of the end connector 10 and the cable C, a plurality of serrations or sawtoothed edges 60 are formed at axially spaced intervals along external surface 24' of the inner extension sleeve 24 at least along a limited distance or length referred to as the crimping zone, the crimping zone being that length of the rearward extension 24' adjacent to its rearward end which is spaced far enough from the forward end of the extension 24' as to avoid any contact with the braided conductor portion 13. The serrations 60 are preferably angled or sloped in a forward direction to resist rearward movement of the cable C once crimped into the annular space 34 in a manner to be described.

In order for the end connector to establish sealed engagement with the outer jacket 15, a series of inner and outer endless rings 62 and 64, respectively, are formed at axially spaced intervals out of the thickness of the outer sleeve 26 and along the crimping zone as described so as to be in opposed, facing relation to the serrations 60. In contradistinction to the endless rings 40 of my hereinbefore referred to U.S. Pat. No. 5,501,616, the endless rings 62, 64 are not merely formed in the inner wall surface of the sleeve 26 but are formed out of the entire wall thickness of the sleeve 26 so as not to increase the overall thickness of the sleeve along the crimping zone and to relieve stress on the outer sleeve wall 32 during crimping. If anything, it is more desirable to slightly decrease the wall thickness of the extension wall 32 along that portion 33 of the extension wall 32 between the rings 62, 64 and the body 27. Preferably, the reduction in wall thickness along the portion 33 is achieved by reducing the outer diameter of the portion 33 so that the crimping tool will engage the external surface portions of the rings hereinafter described prior to engagement of the smooth-surface portion 33 thereby reducing the compressive force necessary to crimp the outer sleeve by radial inward deformation into the reduced conical configuration as illustrated in FIG. 1 from its normal diameter illustrated in FIG. 2. Thus, the radially inwardly directed rings 62 are disposed at uniform, axially spaced intervals along the crimping zone with alternate, intervening radially outwardly directed rings 64 therebetween. Accordingly, each ring 62 defines an inwardly directed or facing rib 63 and complementary outwardly facing groove 63'; whereas the intervening rings 64 each define an outwardly directed rib 65 and inwardly facing groove 65'. Preferably, the rings 62 and 64 are of corresponding width but of uniform thickness along the crimping zone toward the rearward end of the extension wall 32. Thus, the radially inner and outer endless rings 62 and 64 as described essentially define a corrugated circumferential wall section along the crimping zone of the outer sleeve made up of alternating ribs 63 and grooves 65' along the inner surface of the outer sleeve 26.

When the cable C is fully inserted into the end connector 10, the end of the jacket 15 which is covered by the braided conductor 14 will abut the rearward end of the flange 27 on the outer sleeve 26, and the inner conductor pin 12 will project beyond the end of the fastener 36. Inward radial crimping of the rearward extension 32 of the sleeve 26 is preferably carried out with the use a crimping tool as hereinbefore described and which will cause uniform inward radial deformation or reduction in diameter of the rearward end of the extension wall 32, or crimping zone, into a generally conical wall section, as shown in FIG. 1, which will establish uniform sealed engagement with the outer surfaces of the jacket 15. Simultaneously, the serrations 60 are forced into firm engagement with the inner surface of the jacket, and the outer, doubled over portion $\mathbf{14}^1$ of the conductor 14 terminates short of the crimping zone so that the sealing rings 62 make direct sealed engagement with the jacket 15 and effectively form O-ring type seals with the jacket 15.

In the preferred form, at least the corner edges of the inner ribs 63 are radiused or rounded so as not to cut the jacket 15 when crimped into sealed engagement. In addition, the depth of the inner ribs 62 may be varied according to the thickness of the braided conductor 14 and jacket 15 to be conformable for use with different diameter cables. Not only does the formation of complementary grooves and ribs to the thickness of the sleeve 10 minimize the compressive force necessary to crimp the outer sleeve but possesses increased flexibility between the ribs and grooves to most closely conform to any irregularities in the surface of the outer jacket.

Figure 3:
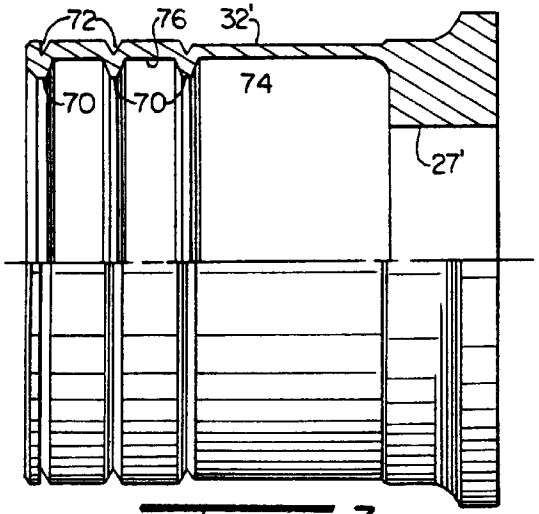
FIG. 3 is a sectional view of a modified form of outer sleeve for an end connector of the present invention.

Although the complementary formation of inner and outer rings 64 in the wall thickness of the outer sleeve 26 is believed to be most effective and useful in the formation of axially spaced, endless rings as described, the cross-sectional configuration of the rings and grooves may be varied so as to be more of a generally V-shaped configuration, such as, for example, the inwardly directed rings or V-shaped teeth 70 illustrated in a modified form of outer sleeve 26' in FIG. 3 and wherein the rings or teeth 70 have complementary external grooves 72 in order to maintain a uniform wall thickness, or substantially so, throughout the crimping zone; and again, that portion 78 of the extension wall 32' between the rings 70 and sleeve body 27' is of lesser thickness than that along the crimping zone to reduce the compressive force required for effective crimping into a conical wall section in the same manner as shown in FIG. 1. Again, the reduction in thickness is effected by reducing the outer diameter, as shown in FIG. 3, since it has been found that when the crimping tool initially engages the surface portions 76 and initiates the radially inward crimping action prior to engagement with the surface portion 78 less crimping force is required. Typically, for an extension wall 32' having a thickness on the order of 1 cm, the reduction in diameter may be on the order of 0.15 cm. The apices of the rings 70 are truncated or slightly rounded as at 74 to minimize any tendency to cut the jacket 15 of the cable C, and the ribs 70 are separated by relatively wide surface portions 76 which effectively form inwardly facing grooves between the ribs 70. In either form of invention shown in FIGS. 1 and 2 or FIG. 3, as opposed to forming separate, axially spaced rings 62, 64 or the ribs 70, it is possible to form one continuous ring or rib of either configuration which would extend in spiral or helical fashion along the crimping zone at an extremely low pitch or angle. However, it has been found that the most effective sealing is achieved by separate axially spaced rings 62 so as not to form a continuous interface between the jacket and ribs along which moisture may seep past the crimping zone.

In the forms of invention herein described, it will be appreciated that when the sleeve is subjected to inward radial deformation by a crimping tool that the complementary ribs 63, 65 and grooves 63', 65' which define the sealing rings 62, 64 can more readily contract lengthwise and radially at least along the external surface of the extension wall while being placed under a limited amount of tension along the inner surface but in any event will substantially relieve the stress throughout its wall thickness and minimize the compressive force required to crimp the outer sleeve into sealed engagement with the jacket. In this relation, the outer sleeve 26 is preferably composed of a more ductile or softer material than the inner sleeve 24. For example, the inner sleeve 24 and fastener 36 may be composed of a nickel-plated material and the outer sleeve 26 may be composed of a tin-plated material. The foregoing applies with equal force to the form of invention shown in FIG. 3 both with respect to relieving stress along the crimping zone and the selection of material for the outer sleeve 26'.

It is therefore to be understood that while preferred and modified forms of invention are herein set forth and described the above and other modifications may be made therein without departing from the spirit and scope of the present invention as defined by the appended claims.

We claim:

1. In a coaxial cable connector for connection to a terminal wherein said cable has radially inner and outer generally cylindrical conductors separated by an annular dielectric and an outer tubular jacket of a sealable material encasing said outer conductor with a portion of said outer conductor being exposed at the end of said cable, the improvement comprising:

radially inner and outer spaced coaxial sleeves, said inner sleeve being sized for insertion of said inner conductor and said annular dielectric therein, said outer sleeve being sized for insertion of said outer conductor and said jacket into an annular space between said inner and outer sleeves; and at least one ring extending circumferentially of said outer sleeve adjacent to said one end, each said ring defined by a radially inwardly directed rib and a complementary radially outwardly facing groove formed out of the thickness of said outer sleeve, each said ring being compressible into direct engagement with said jacket when said jacket is fully inserted into an annular space between said inner and outer sleeves whereupon inward radial compression of said outer sleeve is operative to force external surface portions of said jacket into each said groove and establish sealed engagement therewith.

2. In an assembly according to claim 1 wherein said outer sleeve has a substantially uniform wall thickness at least throughout an area occupied by said ring(s).

3. In an assembly according to claim 1 wherein said outer sleeve is of reduced thickness along a portion of said outer sleeve not occupied by said ring(s).

4. In an assembly according to claim 1 wherein said inner sleeve has external projections along an external wall surface portion of said inner sleeve in facing relation to said rings, and there are a plurality of axially spaced rings in said outer sleeve of spaced substantially equal width.

5. In an assembly according to claim 1 wherein said outer sleeve is provided with a body portion and an extension wall extending in spaced outer concentric relation to said inner sleeve, there being a plurality of rings in axially spaced relation to one another at one end of said extension wall opposite to said body portion, and a portion of reduced outer diameter in relation to that portion occupied by said rings.

6. In an assembly according to claim 1 wherein said rings are of generally truncated V-shaped cross-sectional configuration with inner rounded surface portions engageable with said jacket.

7. In a coaxial cable connector for connection to a terminal wherein said cable has radially inner and outer generally cylindrical conductors separated by an annular dielectric and an outer tubular jacket of a sealable material encasing said outer conductor with a portion of said outer conductor being exposed and doubled over an end portion of said jacket, the improvement comprising:

radially inner and outer spaced coaxial sleeves, said inner sleeve being sized for insertion of said inner conductor and said annular dielectric therein, said outer sleeve being sized for insertion of said outer conductor and said jacket into an annular space between said inner and outer sleeves; and a plurality of alternating inner and outer endless rings extending circumferentially of said outer sleeve adjacent to said one end, each said inner ring having a radially inwardly directed rib and outwardly facing groove, each said outer ring having a radially outwardly directed rib and inwardly facing complementary groove; and wherein said rings are deformable into direct engagement with said jacket in axially spaced relation to said doubled over portion of said outer conductor when said jacket is fully inserted into an annular space between said inner and outer sleeves and said rings are radially compressed into external surface portions of said jacket.

8. In an assembly according to claim 7 wherein said outer sleeve has a substantially uniform wall thickness at least throughout an area occupied by said rings.

9. In an assembly according to claim 7 wherein said outer sleeve has a tapered wall thickness at least throughout an area not occupied by said rings.

10. In an assembly according to claim 7 wherein said inner sleeve has external projections along an external wall surface portion of said inner sleeve in facing relation to said rings, and said rings are of substantially equal width.

11. In an assembly according to claim 7 wherein said outer sleeve is provided with a body portion and an extension wall extending in spaced outer concentric relation to said inner sleeve, there being a plurality of rings in axially spaced relation to one another at one end of said extension wall opposite to said body portion, and a portion of reduced outer diameter in relation to that portion occupied by said rings.

12. In an assembly according to claim 7 wherein said rings are of generally truncated V-shaped cross-sectional configuration with inner rounded surface portions engageable with said jacket.

13. In a coaxial cable connector for connection to a terminal wherein inner and outer spaced concentric sleeves cooperate in retaining an end of a coaxial cable, said inner concentric sleeve provided with a radially outwardly directed flange at its forward end, and a coupling member for drawing a first annular end of said outwardly directed flange on said inner concentric sleeve into flush engagement with a correspondingly sized second annular end of said terminal, said coupling member including a radially inwardly directed flange interposed between a forward end of said outer concentric sleeve and said outwardly directed flange, the improvement comprising:

said inwardly directed flange and said outwardly directed flange having confronting surface portions and a recessed area in one of said confronting surface portions; and an annular sealing member disposed in said recessed area being of a size so as to be compressed at least partially into said recessed area when said inwardly and outwardly directed flanges are drawn into flush engagement with one another in response to movement of said first annular end of said inner concentric sleeve into flush engagement with said second annular end of said terminal.

14. In a connector according to claim 13 wherein said recessed area is formed in the confronting surface portion of said coupling member.

15. In a connector according to claim 14 wherein said recessed area is defined by a beveled end surface radially inwardly of said confronting surface of said coupling member.

16. In a connector according to claim 13 wherein said annular seal member is in the form of an O-ring.

17. In a connector according to claim 16 wherein said seal member is oversized with respect to said recessed area and is operative to maintain said inner connector sleeve in centered relation to said terminal when said coupling member is connected to said terminal.

* * * * *